US010232249B2

(12) United States Patent
Liotta et al.

(10) Patent No.: US 10,232,249 B2
(45) Date of Patent: Mar. 19, 2019

(54) BUILDING BRICK GAME USING MAGNETIC LEVITATION

(71) Applicant: GeekNet, Inc., Fairfax, VA (US)

(72) Inventors: Tyson Liotta, Rockville, MD (US); William Yonkers, Arlington, VA (US); Hans Fex, Sterlling, VA (US)

(73) Assignee: GEEKNET, INC., Fairfax, VA (US)

( * ) Notice: Subject to any disclaimer, the term of this patent is extended or adjusted under 35 U.S.C. 154(b) by 42 days.

(21) Appl. No.: 15/019,435

(22) Filed: Feb. 9, 2016

(65) Prior Publication Data

US 2016/0236075 A1 Aug. 18, 2016

Related U.S. Application Data

(60) Provisional application No. 62/176,262, filed on Feb. 12, 2015.

(51) Int. Cl.

| | |
|---|---|
| ***A63F 3/00*** | (2006.01) |
| ***A63F 9/34*** | (2006.01) |
| ***A63F 9/00*** | (2006.01) |
| ***A63F 9/26*** | (2006.01) |

(52) U.S. Cl.

CPC ..... *A63F 9/34* (2013.01); *A63F 3/00694* (2013.01); *A63F 9/0073* (2013.01); *A63F 9/26* (2013.01); *A63F 2003/00359* (2013.01); *A63F 2003/00362* (2013.01); *A63F 2003/00545* (2013.01); *A63F 2003/00624* (2013.01); *A63F 2003/00646* (2013.01); *A63F 2003/00716* (2013.01); *A63F 2003/00794* (2013.01); *A63F 2250/128* (2013.01)

(58) Field of Classification Search

CPC ..... A63F 9/34; A63F 3/0694; A63F 9/0073; A63F 9/26; A63F 2003/00624; A63F 2003/00545; A63F 2003/00794; A63F 2003/00359; A63F 2003/00362; A63F 2003/00646; A63F 2250/128; A63F 2003/00716

USPC ..... 273/239; 446/129

See application file for complete search history.

(56) References Cited

U.S. PATENT DOCUMENTS

| | | | | |
|---|---|---|---|---|
| 3,196,566 | A * | 7/1965 | Littlefield | G09F 19/12 335/295 |
| 3,425,157 | A | 2/1969 | Hartsock | |
| 3,550,936 | A | 12/1970 | Puttick | |
| 3,764,145 | A | 10/1973 | Schrafft | |
| 3,817,518 | A | 6/1974 | Routson | |
| 3,930,651 | A | 1/1976 | Rader | |
| 3,989,251 | A | 11/1976 | Barlow | |
| 4,011,674 | A | 3/1977 | Jacobson | |
| 4,382,245 | A | 5/1983 | Harrigan | |
| 4,462,596 | A | 7/1984 | Yamamoto | |

(Continued)

*Primary Examiner* — Vishu Mendiratta

(74) *Attorney, Agent, or Firm* — Womble Bond Dickinson (US) LLP

(57) ABSTRACT

Described herein are systems and methods for stacking block games, which may include a game board or base including magnetized portions and a hover platform having at least one magnet connected thereto and being suspended above the game board or base and in a floating or hovering arrangement that can be generated by magnetic repulsion between the magnet of the platform and the magnetized portions of the game board or base. Further, a plurality of game pieces may be arranged in a stacked orientation on the platform.

12 Claims, 10 Drawing Sheets

(56) References Cited

U.S. PATENT DOCUMENTS 4,486,729 A 12/1984 Lee
4,874,346 A * 10/1989 Wachspress ..... A63H 33/26 310/90.5
4,910,633 A 3/1990 Quinn
4,991,836 A * 2/1991 Joffe ..... A63F 9/34 273/239
5,135,425 A 8/1992 Andrews et al.
5,182,533 A 1/1993 Ritts
5,328,188 A * 7/1994 Brotz ..... A63B 67/06 273/129 R
5,344,148 A 9/1994 Asch
5,411,262 A 5/1995 Smith
5,467,244 A 11/1995 Jayawant et al.
5,506,459 A 4/1996 Ritts
5,611,544 A 3/1997 Grebler et al.
5,732,636 A 3/1998 Wang et al.
D397,376 S 8/1998 Hwang
5,826,872 A 10/1998 Hall
5,827,104 A 10/1998 Zheng
5,865,661 A * 2/1999 Cyrus ..... A63H 18/14 446/136
5,883,454 A 3/1999 Hones et al.
5,913,707 A 6/1999 Roman et al.
5,944,575 A 8/1999 Tolnay
5,974,977 A 11/1999 Johnson et al.
6,022,026 A 2/2000 Johnson
6,037,853 A 3/2000 Chabay
6,116,982 A 9/2000 Roman et al.
6,158,740 A 12/2000 Hall
6,161,832 A 12/2000 Holahan et al.
6,237,914 B1 5/2001 Saltanov et al.
6,280,282 B1 8/2001 Puchalski
6,359,767 B1 3/2002 Ooyama et al.
6,373,676 B1 4/2002 Baker et al.
6,413,138 B1 * 7/2002 Dokoupil ..... A63H 33/26 446/129
6,608,540 B1 8/2003 Hones et al.
6,637,745 B1 10/2003 Vardanyan
6,652,214 B1 11/2003 Barry
6,679,496 B2 1/2004 Grebler
6,702,291 B2 3/2004 Grebler et al.
6,702,641 B2 3/2004 Oakley
6,739,938 B2 5/2004 Dokoupil
6,761,610 B2 7/2004 Fisher et al.
6,846,216 B1 1/2005 Balanchi
6,969,294 B2 11/2005 Vicentelli
7,036,277 B2 5/2006 Burginger
7,059,606 B2 6/2006 Butcher et al.
7,110,236 B2 9/2006 Joachim
7,234,986 B2 6/2007 Kowalski et al.
7,276,270 B2 10/2007 Vicentelli
7,348,691 B2 3/2008 Davis et al.
7,371,147 B2 5/2008 Tusacciu
7,505,243 B2 3/2009 Davis et al.
7,559,821 B2 7/2009 Pacheco
7,641,534 B2 1/2010 Holman
7,677,946 B2 3/2010 Mayer
7,722,427 B2 5/2010 Yamana
7,833,078 B2 11/2010 Kretzschmar
7,918,708 B2 4/2011 Kowalski
7,980,913 B1 7/2011 D'Avanzo
8,074,922 B2 12/2011 Bojiuc
8,083,566 B2 12/2011 Finlan
8,100,735 B2 1/2012 Park
8,128,452 B2 3/2012 Kim et al.
8,157,608 B1 4/2012 Stapleton
8,210,893 B2 7/2012 Jackson et al.
8,258,663 B2 9/2012 Smoot et al.
8,282,438 B2 10/2012 Tamulewicz et al.
8,337,270 B2 12/2012 Mimlitch et al.
8,348,279 B2 1/2013 Burton
8,382,548 B2 2/2013 Maggiore
8,382,550 B2 2/2013 Kang
8,387,989 B2 3/2013 Baum
8,475,225 B2 7/2013 Kretzschmar
8,475,226 B2 7/2013 Comfort
8,490,974 B2 7/2013 Stolten
8,540,545 B2 9/2013 Leicht
8,671,640 B1 3/2014 Thomas
8,717,129 B1 5/2014 Cash
8,753,163 B2 6/2014 Gaute
8,753,164 B2 6/2014 Hansen
8,764,508 B1 7/2014 Eckard et al.
8,814,629 B2 8/2014 Johnston
8,814,688 B2 8/2014 Barney
8,834,225 B2 9/2014 Ferron
8,850,683 B2 10/2014 Haughey et al.
8,851,953 B2 10/2014 Oschuetz
8,939,154 B2 1/2015 Mintchev et al.
8,961,259 B2 2/2015 Maggiore
9,061,200 B2 6/2015 Leicht
9,061,761 B2 6/2015 Belisle
9,120,029 B2 9/2015 Poulsen
9,124,196 B1 9/2015 Honein et al.
9,126,487 B2 9/2015 Henderson et al.
9,597,978 B1 * 3/2017 Konchitsky ..... B60L 13/04
2002/0123294 A1 * 9/2002 Dokoupil ..... A63H 33/26 446/129
2003/0027483 A1 2/2003 Rosenberg
2003/0036333 A1 2/2003 Oakley
2004/0244636 A1 * 12/2004 Meadow, Jr. .... A63B 21/00192 104/284
2005/0029735 A1 2/2005 Liu et al.
2006/0244212 A1 * 11/2006 David ..... A63F 3/0023 273/239
2008/0200092 A1 8/2008 Chung
2009/0093182 A1 4/2009 Jacobs et al.
2009/0141491 A1 * 6/2009 Chu ..... F21V 3/023 362/231
2009/0170396 A1 7/2009 Tardif et al.
2010/0291831 A1 11/2010 Yamada
2011/0009028 A1 1/2011 Gurdin et al.
2011/0294391 A1 12/2011 Todd
2013/0029559 A1 1/2013 Tremblay et al.
2013/0072083 A1 3/2013 Ghaly
2013/0109267 A1 5/2013 Schweikardt et al.
2014/0011424 A1 1/2014 Comfort
2014/0017975 A1 1/2014 Maurer
2014/0197596 A1 * 7/2014 McIlwaine ..... A63F 9/34 273/239
2014/0213139 A1 7/2014 Ferguson
2014/0227934 A1 8/2014 Rudisill et al.
2014/0273730 A1 9/2014 Brandwijk
2014/0300050 A1 10/2014 Stolten
2014/0378023 A1 12/2014 Muthyala et al.
2015/0044938 A1 2/2015 Chieffo
2015/0065007 A1 3/2015 Klepper
2015/0072587 A1 3/2015 Ornstein
2015/0104993 A1 4/2015 Kennedy
2015/0190725 A1 7/2015 Berglund et al.
2015/0213934 A1 7/2015 Michaelis
2015/0224418 A1 8/2015 Musliner
2015/0231488 A1 8/2015 Hedeen et al.
2015/0231521 A1 8/2015 Peterson
2015/0246293 A1 9/2015 Kokhan
2015/0251104 A1 9/2015 Lange et al.
2015/0258461 A1 9/2015 Balanchi

* cited by examiner

BUILDING BRICK GAME USING MAGNETIC LEVITATION

CROSS REFERENCE TO RELATED APPLICATIONS

The present patent application is a formalization of previously filed, co-pending U.S. Provisional Patent Application Ser. No. 62/176,262, filed Feb. 12, 2015 by the inventors named in the present application. This patent application claims the benefit of the filing date of this cited Provisional patent application according to the statutes and rules governing provisional patent applications, particularly 35 U.S.C. § 119(e), and 37 C.F.R. §§ 1.78(a)(3) and 1.78(a)(4). The specification and drawings of the Provisional patent application referenced above are specifically incorporated herein by reference as if set forth in their entirety.

TECHNOLOGY FIELD

The present disclosure generally relates to games. In particular, embodiments of the present disclosure relate to brick building or stacking games in which game pieces are stacked on a platform hovering over a magnetized game board.

BACKGROUND

Games represent a popular form of personal entertainment. From puzzles to board games, people are always looking for new challenges and, in turn, more challenging games. As such, a need exists for new and ever more challenging games and/or other, similar forms of entertainment.

SUMMARY

Briefly described, embodiments of this disclosure are directed to a levitating stacking block game or brick building game having a game base with an upper surface at least partially defining an area of play for the game, and a series of magnets disposed adjacent to this upper surface. The game can further include a hover platform with a body having a top surface and at least one magnet arranged therealong, which hover platform can be suspended above the upper surface of the game base in a levitating arrangement generated at least in part by a magnetic repulsion between the magnet of the hover platform and one or more of the series of magnets of the game base. The game may also have a plurality of game pieces with varying/differing configurations and one or more planar surfaces, which game pieces can be configured to be arranged in stacked orientations on the top surface of the hover platform so the platform at least partially supports the game pieces in a floating arrangement above the upper surface of the game base. During play of the levitating stacking block game, one or more players stack game pieces successively onto the hover platform to form block structures of varying arrangements on the hover platform without the game pieces becoming unstacked.

Additionally, according to embodiments of this disclosure, a method for playing the stacking block game may include suspending a hover platform in a levitating arrangement over a game base by a magnetic repulsion force generated between at least one magnet connected to the hover platform and one or more magnets coupled to the base, and successively stacking a series of game blocks on an upper surface of the hover platform, with the game blocks having a plurality of size or shape blocks each with a series of surfaces configured for stacking of the blocks on the hover platform and on other ones of the blocks so as to form varying block arrangements supported by the platform.

Various features, objects and advantages of aspects of the present invention will become apparent to those skilled in the art upon a review of the following detailed description, when taken in conjunction with the accompanying drawings.

BRIEF DESCRIPTION OF THE DRAWINGS

The foregoing and/or other aspects and utilities of the present general inventive concept will become apparent and more readily appreciated from the following description of the embodiments, taken in conjunction with the accompanying drawings. For the purpose of illustration, forms of the present general inventive concept which are presently preferred are shown in the drawings; it being understood, however, that the general inventive concept is not limited to the precise arrangements and instrumentalities shown. In the drawings.

DETAILED DESCRIPTION

Figure 1:
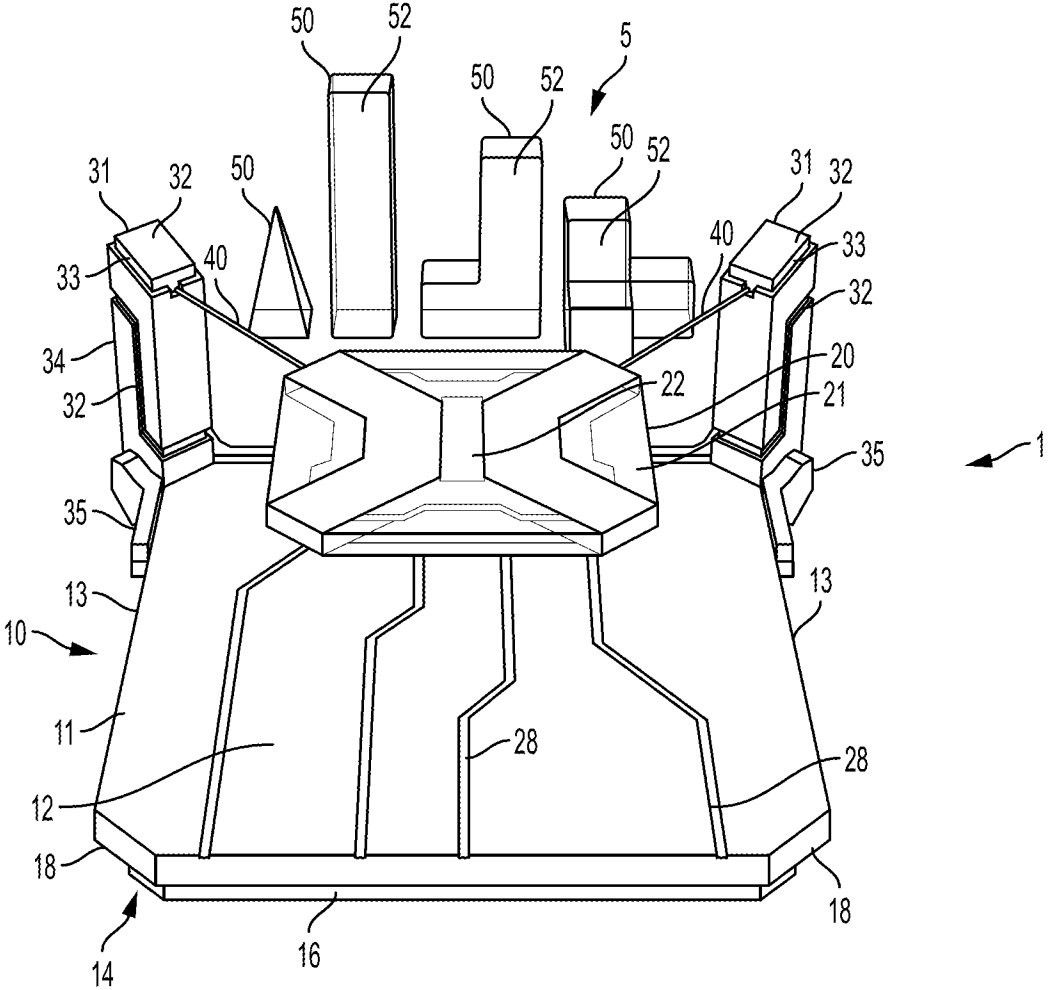
FIG. 1 is a perspective view of a building brick game according to embodiments of the present disclosure.

According to embodiments of the presently disclosed invention, a building brick game 1 is provided, wherein one or more players are challenged to build structures, or prevent their opponent(s) from doing so, using a variety of different sized and/or configured game pieces 5 on a floating platform. As illustrated in FIGS. 1-8, the game or game assembly or game board assembly 1 generally will comprise a series of game pieces 5, a game board or base 10, and a hover platform 20. The hover platform 20 may generally be suspended over the base or game board 10 in a floating or hovering arrangement using magnetic repulsion or levitation. As part of the building brick or levitating stacking block game, players can attempt to stack the game pieces 5 on the hover platform 20 as it is suspended, floats or hovers over the base 10. Various embodiments of the present disclosure are discussed below.

Figure 8:
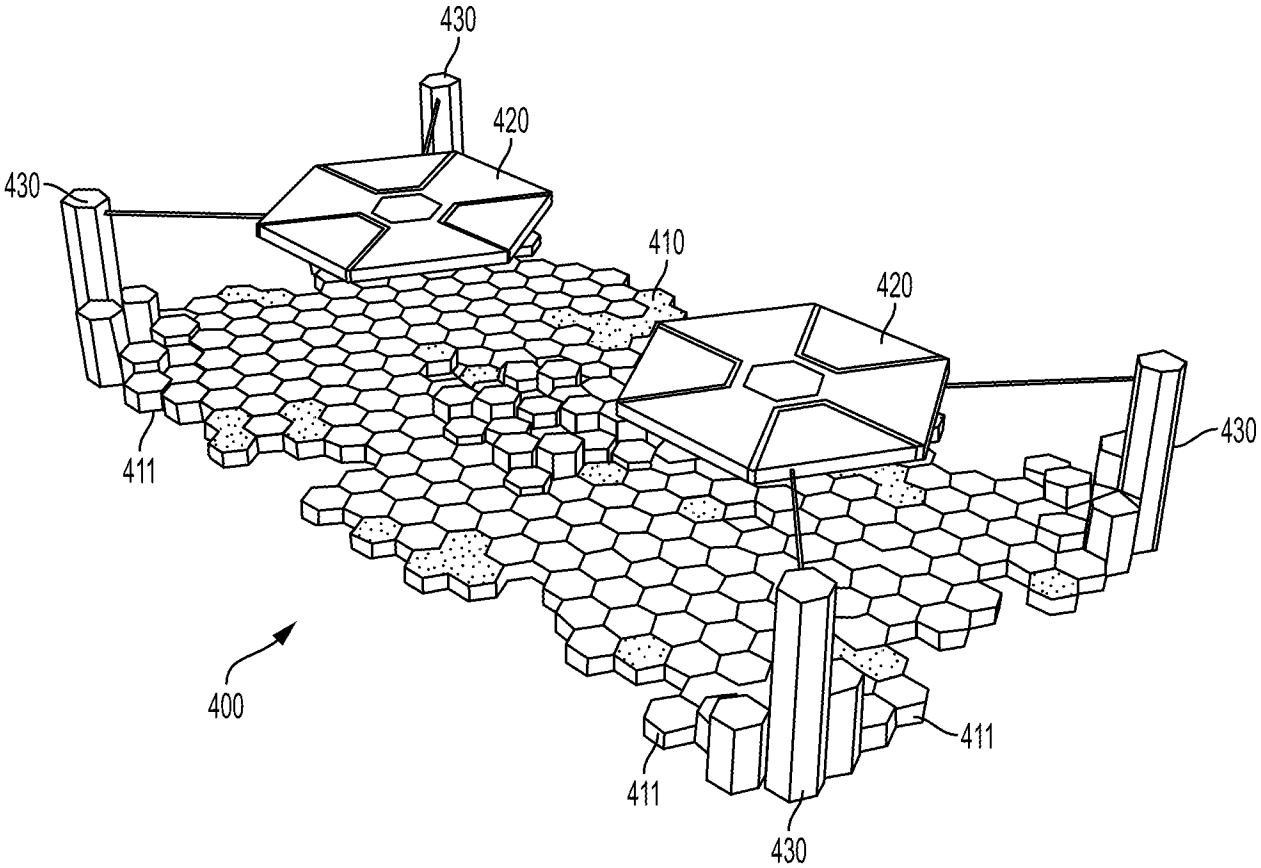
FIG. 8 is a side elevation view of the building block game according to a further alternative embodiment of the present disclosure.

As illustrated in FIGS. 1-8, the game board or base 10 generally will define a three dimensional body that can be formed in various configurations. For example, FIGS. 1-4 show a substantially square base 10, FIGS. 5A-7 an elongated and/or rectangularly shaped base 110, 210, 310, while FIG. 8 shows a base with a variable configuration wherein users/players can build their own board designs. As also indicated, multiple game boards or bases could further be linkable or otherwise put together in a mating or nesting relationship to provide expansion of the game, such as to add players.

In the embodiment shown in FIGS. 1-3B, the game board or base 10 can have a top portion 11 with a generally flat upper or top surface 12 and side edges 13, and a lower or bottom portion 14 including downwardly projecting walls 16 defining a chamber or recessed area 17 under the base. As further indicated in FIGS. 1-3B, this chamber 17 can be recessed, so as to be generally hidden from view during play of the game/use of the game board 10. The corners 18 of the base 10 also may be beveled and/or can be provided with connectors for attachment of support members or towers 30 thereto. Additionally, the lower portion 14 of the base 10 can be connected to the top portion 11 of the base 10 by a plurality of fasteners, such as screws 10A, which can be inserted into apertures 10B defined in the lower portion 14 of the base 10 and secured to receiving portions 10C connected to the top portion of the base 10. The base 10 can have a length of approximately 6-12 inches, although other, varying dimensions also can be provided. The base 10 further is not limited to a square shape and may have any suitable shape, such as a rectangle, circle, triangle, or octagon, including a variety of user definable shapes as generally indicated in FIG. 8. The base 10 further generally can be made of plastic, composite, or other suitable materials.

Figure 3A:
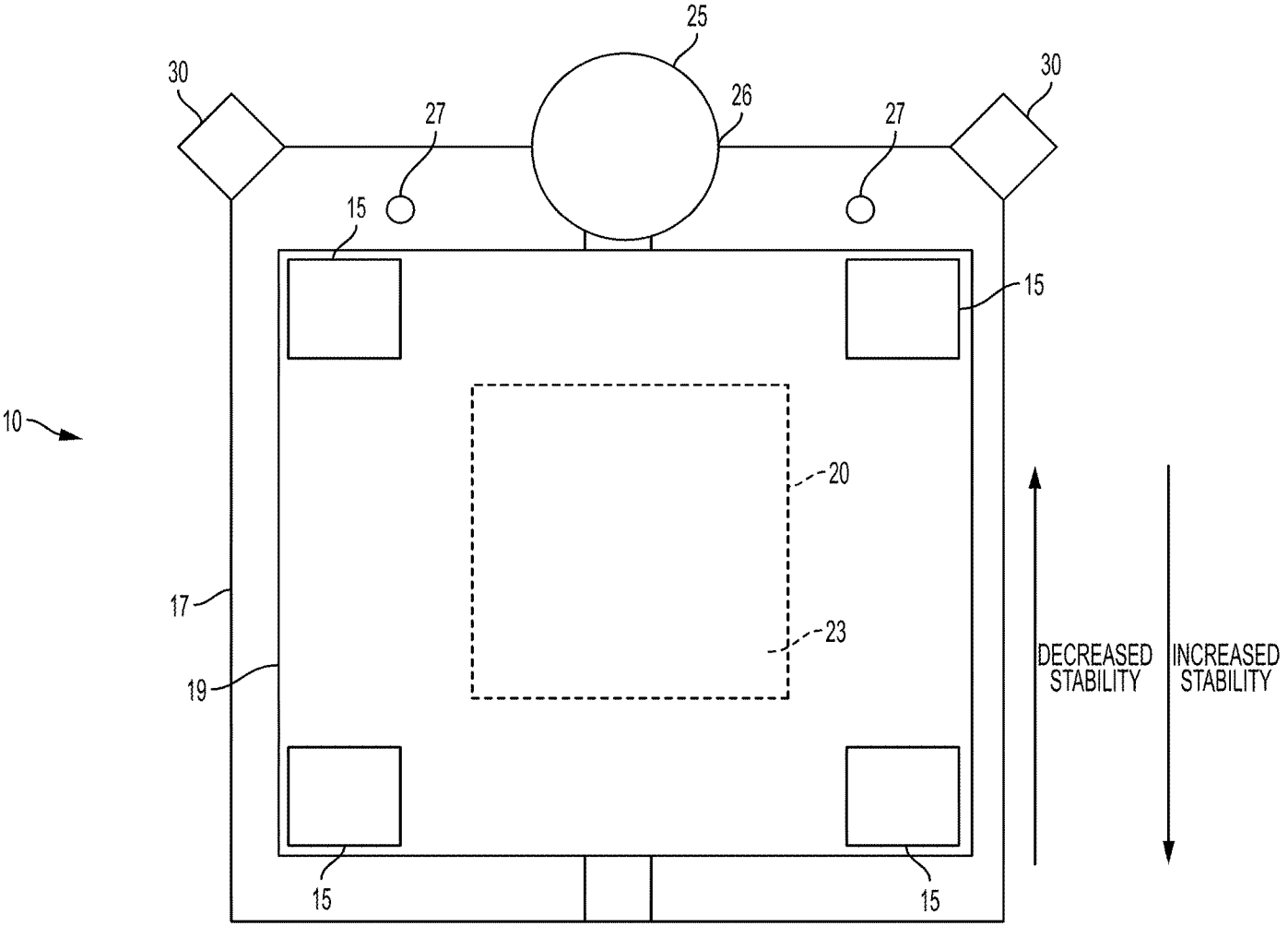
FIG. 3A is a plan view, taken in cross-section, of the game board of the building brick game according to embodiments of the present disclosure.
Figure 3B:
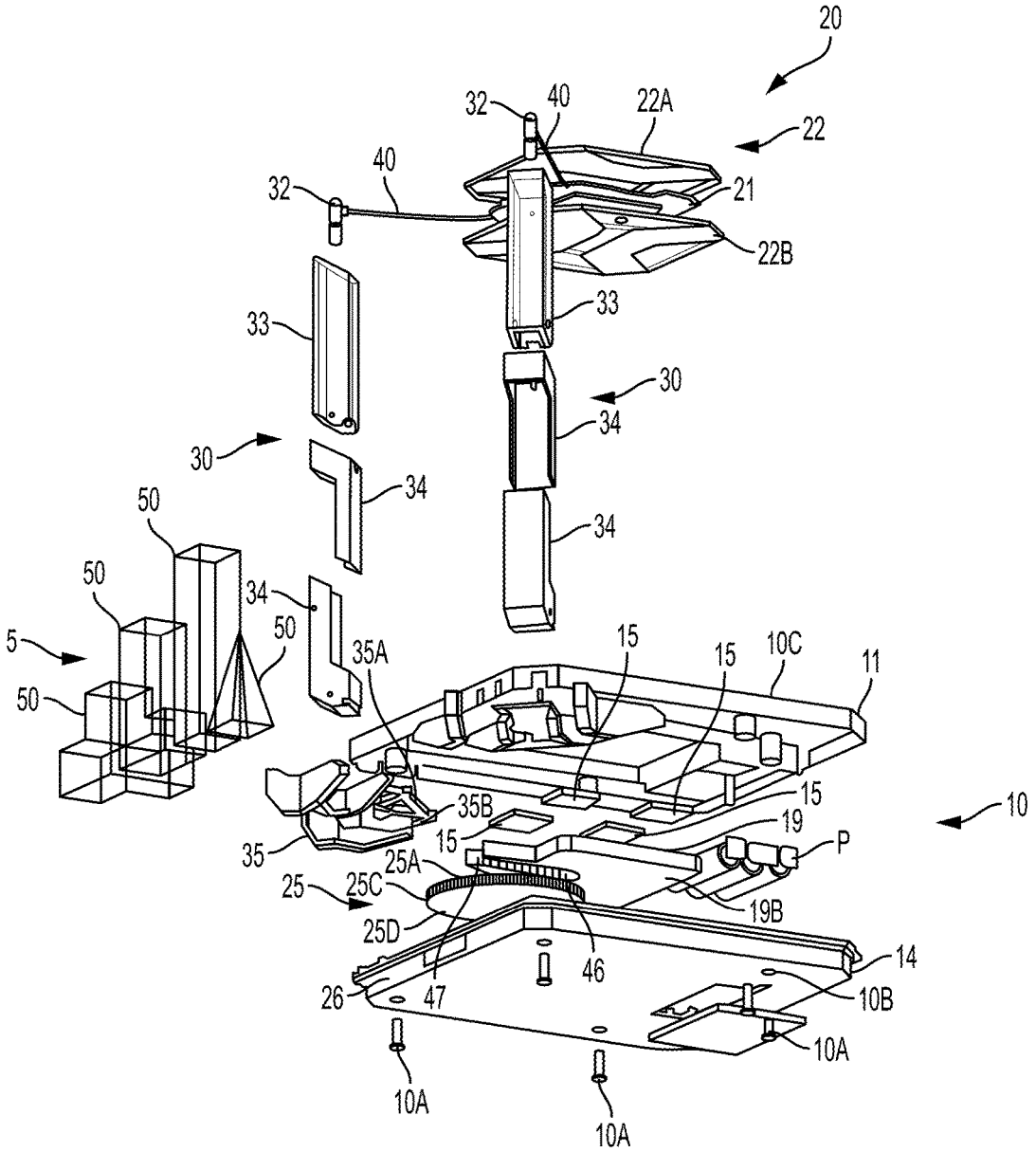
FIG. 3B is an exploded perspective view of the building block game according to embodiments of the present disclosure.
Figure 5A:
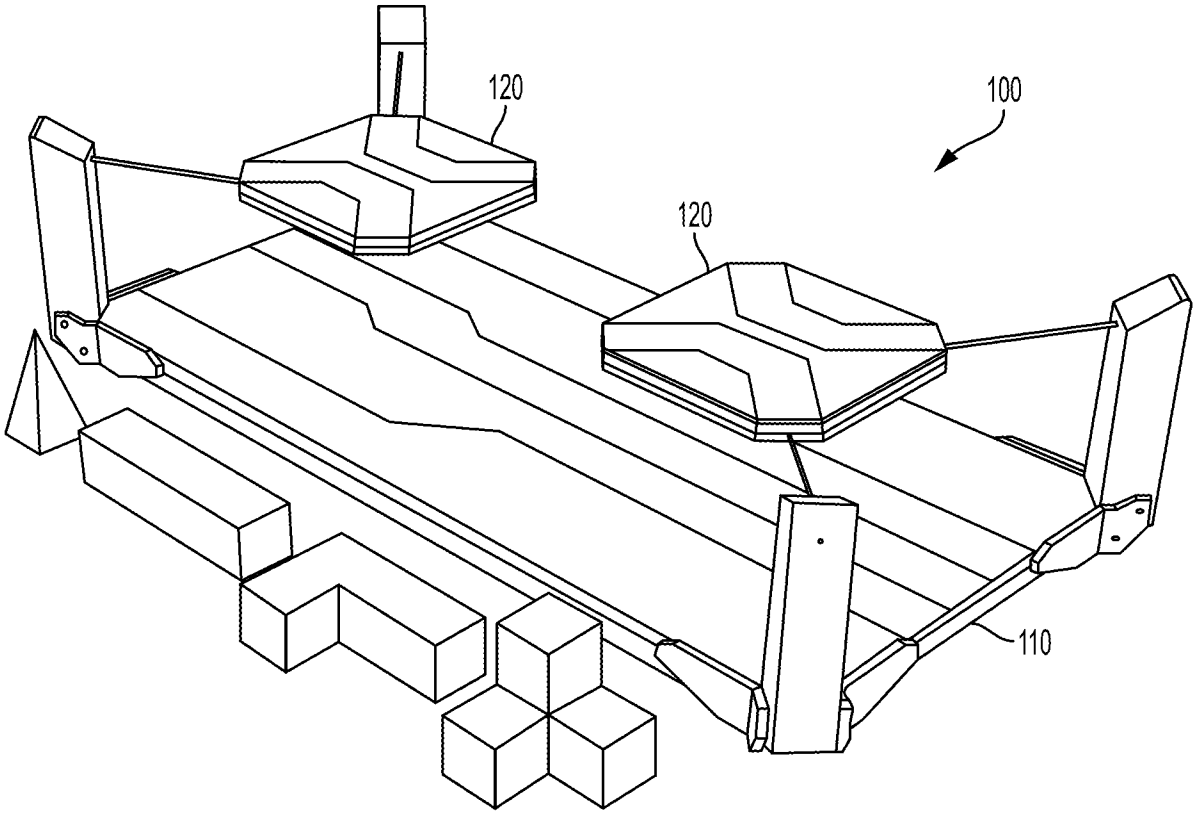
FIG. 5A is a perspective view of the building block game according to an alternative embodiment of the present disclosure.
Figure 5B:
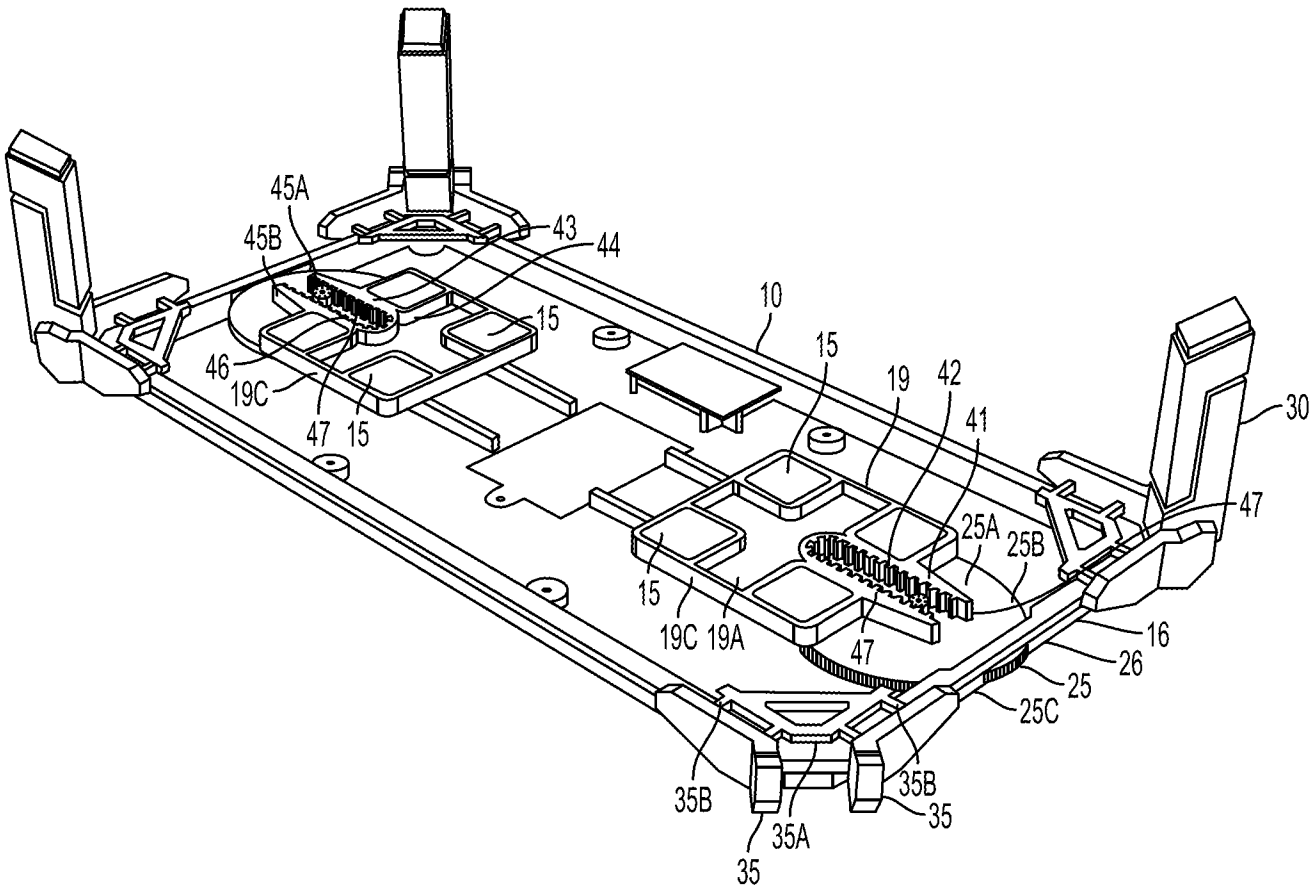
FIG. 5B is a perspective view of the building block game of FIG. 5A with parts broken away.

As shown in FIGS. 3A-3B and 5B, a series of magnets 15 housed within a tray 19 can be disposed within the chamber of the base 10. In one embodiment, the magnets can be rare-earth magnets, though the magnets may also include other permanent magnets or any suitable magnetized material without departing from the present disclosure. The magnets generally will be positioned in the tray 19 such that magnets 15 are in a spaced arrangement. For example, as indicated in FIGS. 3A and 5B, a series of magnets can be arranged in a generally square arrangement, positioned with one magnet disposed adjacent each of the corners of the base and generally located outside the perimeter of the hover platform 20. While four magnets are shown more or fewer magnets can be used, and further can be arranged in other configurations or spacings. Multiple magnets can be used in either the base 10 or the hover platform 20, with the magnets in the platform generally being spaced closer together while the magnets in the base 10 are generally spread apart across a larger area than those in the hover platform 20. The magnets in the base 10 and the hover platform 20 further generally will have the same poles facing each other, such that they repel each other and the hover platform 20 is suspended above the upper surface 12 of the base 10 in a levitating or floating arrangement/configuration. Instead of fixed magnets, electromagnets could also be used in the base 10 and/or the hover platform 20 to achieve the same effect.

As additionally shown in FIGS. 3A-3B and 5B, the base 10 can include a dial or lever 25, or other, similar manipulatable actuator, configured for enabling adjustment of the positions of the magnets 15. The dial 25 can be housed in a slot 26 defined in one of the side walls 16 of the lower portion 14 of the base 10 and will engage the tray 19. According to one embodiment of this disclosure, the tray 19 can be moved towards and away from the corners at which the towers 30 are attached to the base 10 when the dial 25 is rotated. For example, as illustrated in FIGS. 3B and 5B, the dial 25 can have a body 25A including a substantially circular shape, with top portions 25B, side portions 25C, and a bottom portions 25D. A substantially circular gear 41 having a series of teeth 42 disposed thereabout, can be connected to the body 25A of the dial. Further, the tray 19 can include a body 19A, which can have a substantially rectangular shape, or other suitable shape, that can have a bottom portion 19B and side walls 19C. The tray 19 further can be integrally formed with or connected to a u-shaped track 43 with a track body 44 that can have substantially straight interior and exterior walls 45A/B. The exterior walls 45B can be disposed inside a u-shaped aperture 46 defined in the body of the tray, and the interiors walls 45A can be disposed on opposing sides of the gear 41 and can have a substantially flat surface with teeth 47 disposed thereon and which are configured to engage with the teeth 42 of the gear 41, such that when the dial 25 is rotated the tray 19 moves towards and away from the corners at which the towers 30 are attached to the base 10. The bottom surface portion of the tray 19 also can have a substantially flat top surface with walls protruding therefrom to house the magnets 15.

The movement of the tray 19 allows for adjustment of the position of the magnets 15 with respect to the hover platform 20 above the top of the base (FIGS. 3B and 5B), which, in turn, enables variation of the relative stability of the hover platform 20. For example, when the tray 19 (and thus the magnets 15) is moved away from towers 30, stability of the hover platform 20 can be increased. Conversely, when the tray is moved toward towers 30, stability of the hover platform 20 can be decreased. In this regard, when the tray is at a position farthest away from the towers 30, the hover platform 20 generally is more stable, and when the tray is at a position closest to the towers 30, the stability of hover platform 20 will be lessened. In other words, when players stack the pieces on the hover platform 20, the hover platform 20 will be increasingly likely to topple over, with the pieces falling off, as the tray is moved closer to the towers 30. Such adjustment of the magnets can thus provide a user selectable challenge level to the game.

Figure 2:
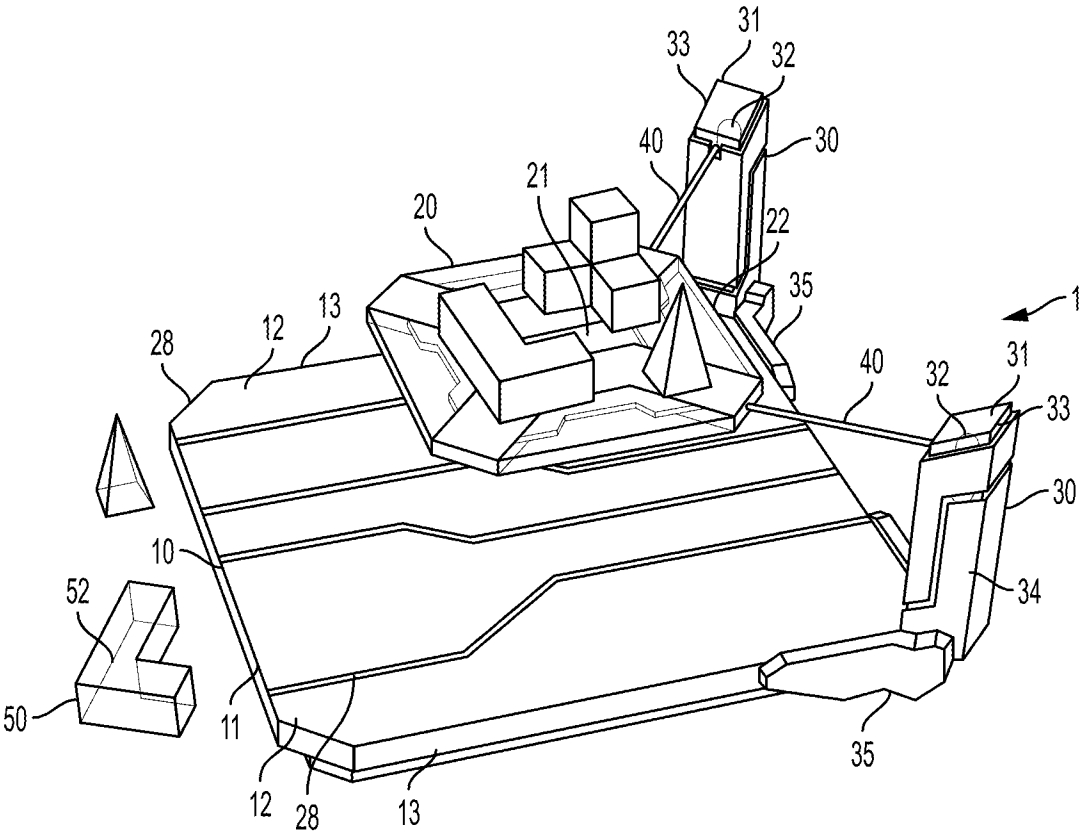
FIG. 2 is a perspective view of the building brick game of claim 1.

The base 10 also may include one or more lights 27. Such lights may include light-emitting diodes (LEDs) or any other suitable light source. Further, the upper surface 12 of the base 10 may comprise a transparent surface, in whole or in part. For example, as illustrated in FIGS. 1-2, the upper surface 12 may include groves 28 that extend therealong in a desired pattern and which enable light emitted from lights source(s) to exit through groves 28 to illuminate the game board or base 10. Alternatively, as shown in FIG. 8, for user configurable game boards or game boards formed with or from multiple pieces, lights can be provided in or along individual pieces or sections of the board. Still further, the upper surface of the game board can include movable sections to provide different illumination and looks thereto. A power source P, such as a battery or plug in power cord, further can provided to power one or more of the light sources. The power source P can be housed within the chamber 17 of the base 10 (FIG. 3B) and additionally may include a series of batteries or other suitable power source.

According to embodiments of the present disclosure, the hover platform 20 will typically be disposed above the game board or base 10, floating or hovering by magnetic levitation or repulsion effects. As shown in FIGS. 1-2 and 3B, the hover platform 20 will include one or more hover platform magnets 21 housed within the body 22 of the hover platform 20. The hover platform magnets 21 can be disposed substantially adjacent to the center of the hover platform 20, and generally can be positioned so that an outer periphery of the arrangement of hover platform magnets 21 can fall within a perimeter defined by the magnets 15 housed within the base 10. The hover magnets 21 also can be rare-earth magnets or other permanent magnets or magnetized material, and generally will be of an opposite polarity to the magnets 15 of the base 10. As further illustrated in FIG. 3B, the body 22 of the hover platform 20 can include a top portion 22A and a bottom portion 22B that can be connected together to house the hover platform magnets 21. These portions 22A and 22B may be snapped together and/or connected together in other ways, such as with fasteners or adhesives. The top portion 22A of the hover platform may have an upper or top surface 23, such as a substantially flat upper surface, generally configured and dimensioned to receive/support a series of game pieces 5.

Additionally, as illustrated in FIGS. 1-2, the hover platform 20 generally will include a three dimensional body 22, shown in one embodiment with a substantially square configuration. In one example embodiment, the dimensions of the hover platform 20 can be approximately one half of dimensions of the base 10 although other dimensions also can be provided. The configuration of the hover platform 20 further is not limited to a square shape, and any suitable shape, such as a rectangle, circle, triangle or octagon, or other suitable shape can be used. The hover platform 20 may be made of plastic, wood, composite or any other suitable material.

With embodiments of this disclosure, such as those illustrated in FIGS. 1-2, 3B, and 5A-8, the game board 10 further will include supports or towers 30 attached to the game board or base 10 and extending upward generally in a direction substantially normal to the upper surface 12 of the base 10, so that the upper ends or surfaces 31 of the towers 30 are spaced above the top surface of the base 10 at a selected elevation "E." The towers 30 further may be movable such that they can be attached at various positions on the base 10. The towers 30 could be movable as needed to adjust the balance rather than having the dial 25 adjust the position of the magnets underneath. As illustrated in FIGS. 1-2, the towers 30 generally will be connected to the hover platform 20 by connecting members or guide lines, for example, wires 40 to provide stability for the hover platform 20. Other connecting lines, cables or members also can be used in place of the wires 40. Generally the wires 40 may be connected to two corners of the hover platform 20 and to the towers 30 adjacent the upper ends 31 thereof. By connecting the hover platform 20 to the ends of the towers 30 that are elevated above the top surface of the base 10 via the wires 40, sufficient stability of the hover platform 20 can be achieved using only two wires. However, other wire configurations also can be used.

As further illustrated in FIGS. 1-2 and 3B, the towers 30 each may define a three-dimensional columnar shape, and may contain lights 32, such as LEDs, or other light sources, housed within the towers 30, which lights 32 can be powered by the same battery or power source P as the lights of the base 10. The towers 30 also may be made up of transparent sections or surfaces 33 and opaque sections or surfaces 34 disposed along the transparent sections or surfaces 33. For example, the opaque surfaces 34 may include groves 36 and the portions of the transparent surfaces 33 can remain exposed. As such, the light emitted from lights 32 of the towers may exit through the exposed transparent surfaces and/or through the groves of the towers 30 to further illuminate the game board 10. Alternatively, light from the light sources contained in the base or game board 10 also can be used to illuminate the towers such as by reflection or refraction of the light transmitted by these light sources.

Additionally, as illustrated in FIGS. 1-2 and 3B, the towers 30 may be attached to the base 10 by connectors such as flanges 35. The flanges 35 can have a generally L-shaped structure, and may adjoin a side surface of the base 10 to a side surface of the towers 30 to help hold the towers 30 upright. The two flanges 35 may further connect to each tower 30 to a corner of the base 10. As further illustrated in FIGS. 3B and 5B, a connector 35A, can connect two or more flanges 35 together such that they are flush with the corners 18 of the base 10, and these connectors 35A can hold the flanges 35 in place when the top portion 11 of the base 10 is connected to the lower portion 14 of the base 10 securing the connectors between the top and bottom portions. The flanges 35 can be releasably connected to the connectors 35A by protrusions 35B. Other connectors and/or connector assemblies also can be used.

According to some embodiments of the present disclosure, the wires 40 further may be conductive so as to provide power to lights 29 mounted within or attached to the hover platform 20. For example, lights 29 can be contained within the body 22 of the hover platform 20, and the hover platform 20 can have a transparent surface so as to be illuminated by light emitted from such lights.

The levitating stacking block or building brick game/game board assembly 1 also may include a series of different game pieces 5, here shown as including stackable blocks 50. The stackable blocks 50 may include various shapes, sizes or configurations, such as, for example, different three dimensional shapes, which may include pyramids, corner tetra cubes, L-shaped tetra cubes, and straight tetra cubes or any combination thereof. Each of these blocks 50 may include one or more stacking surfaces, such as one or more planar surfaces 52, and may further be configured to be stacked/arranged in various stacked orientations/configurations on, for example, the top/upper surface 23 of the hover platform 20. During play of the levitating stacking block or building brick game, players may attempt to successively stack the game pieces 5 onto the hover platform to form/build a series of block structures having different/varying arrangements or configurations, while attempting to prevent the game pieces from falling over or becoming unstacked. In one example embodiment, the building block game may include six pyramids blocks, six corner tetra cubes, six L-shaped tetra cubes, and six straight tetra cubes, although other configurations and/or numbers of blocks also can be used. The blocks 50 may be made of plastic or any other suitable material. Further, the material of blocks 50 may include a transparent material.

Figure 4:
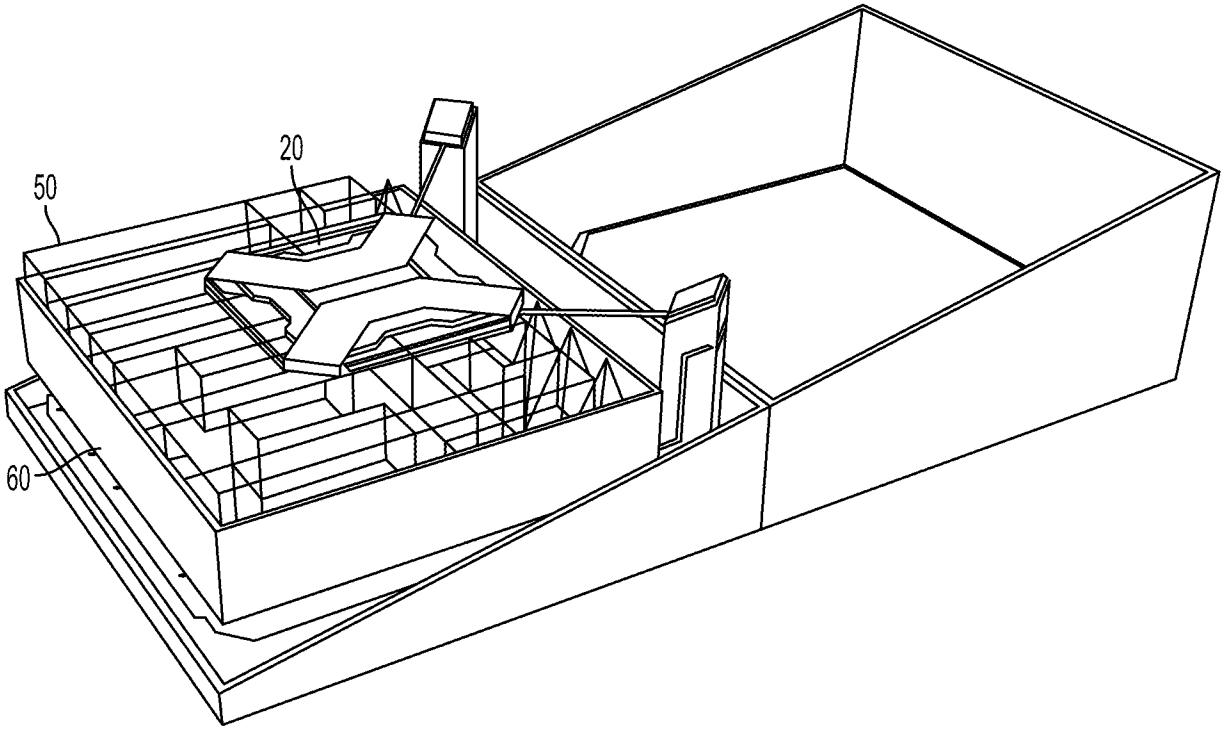
FIG. 4 is a perspective view showing an example packaging arrangement for the building brick game including a block tray.

As further illustrated in FIG. 4, the building brick game 1 further may include packaging such as a block tray 60 configured to house the game board 10 and game pieces/blocks 50. For example, the block tray 60 may be dimensioned such that the block tray 60 can be placed on the top surface of the base 10 underneath the hover platform 20 when the building brick game is to be stored (FIG. 4). Further, the blocks 50 can be positioned in the block tray 60 such that the hover platform 20 can be stored with the blocks 50.

FIGS. 5A-7 show alternative embodiments of the present disclosure. In the embodiment shown in FIGS. 5A-7, the game 100 may include a board or base 110 with a body that has a rectangular elongated configuration. Further, the game board 110 may include two or more hover platforms 120 disposed above the base 110 to alter the game play of the brick building game.

Figure 6:
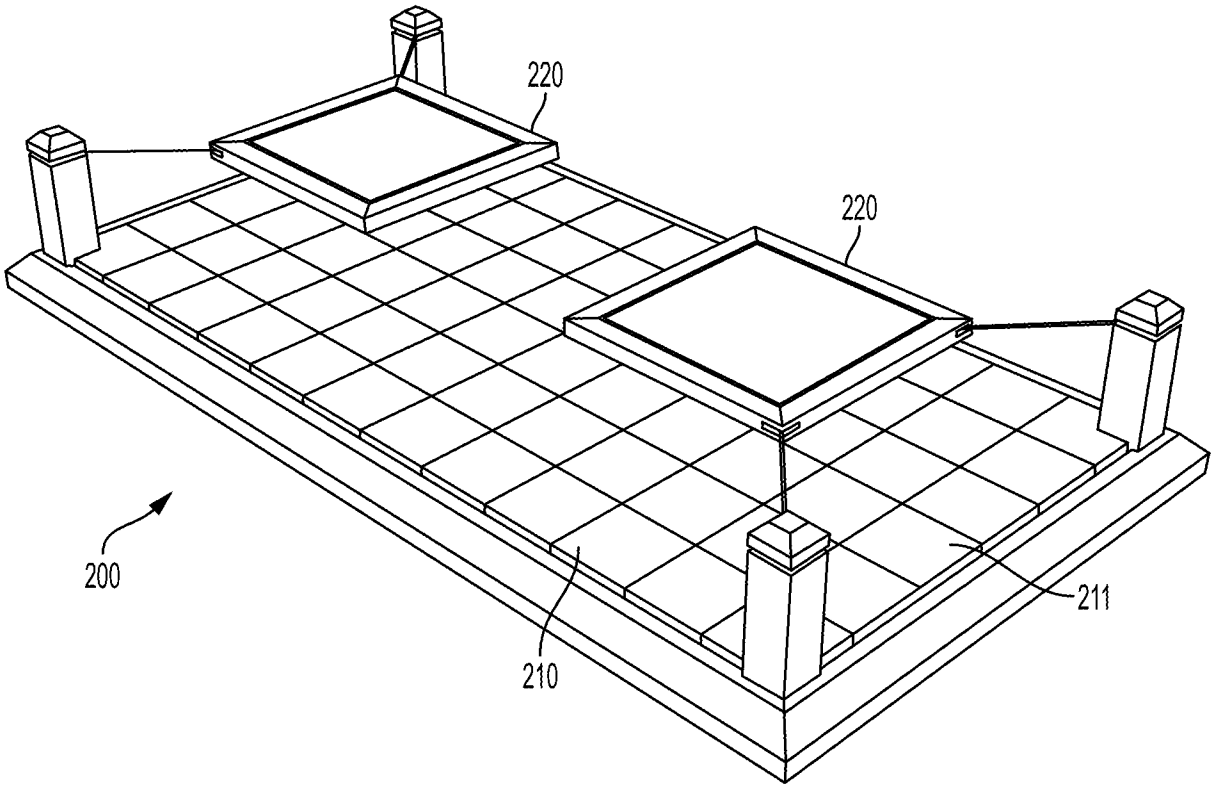
FIG. 6 is a perspective view of the building block game according to another alternative embodiment of the present disclosure.
Figure 7:
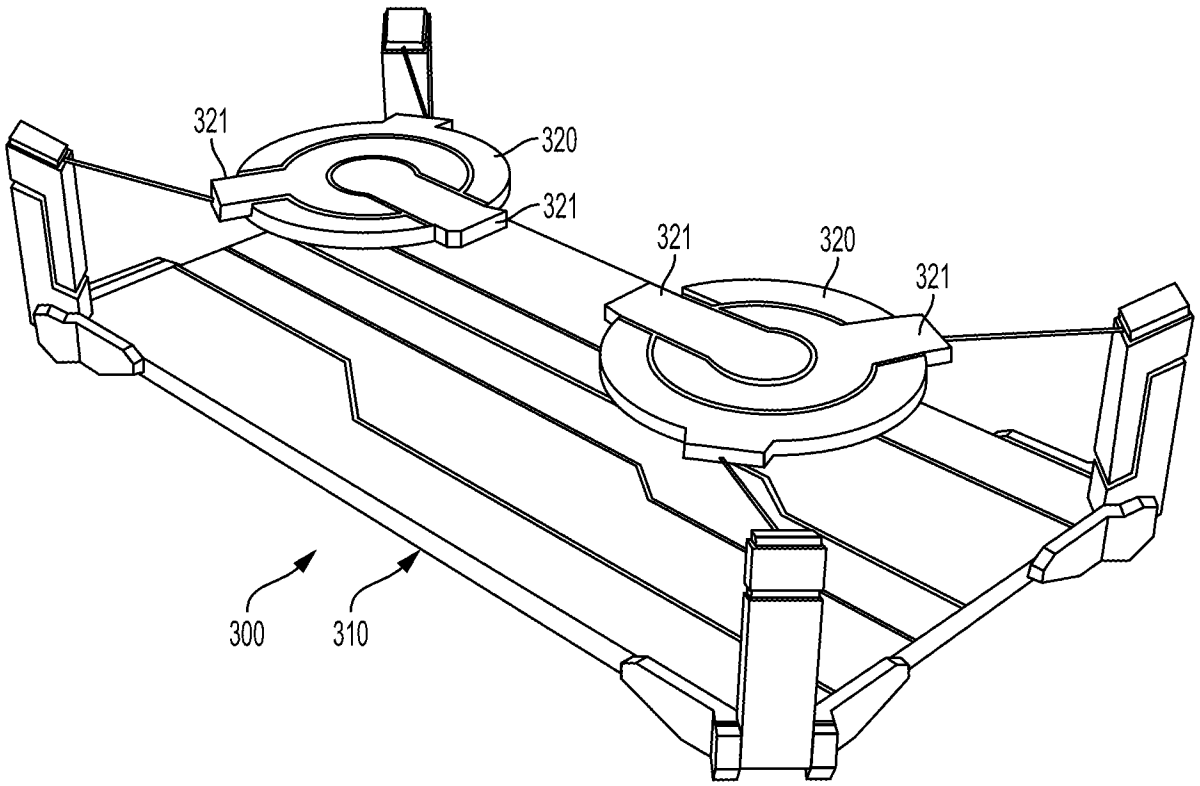
FIG. 7 is a perspective view of the building block game according to yet another alternative embodiment of the present disclosure.

In other embodiments of the present disclosure, as illustrated in FIG. 6, the game 200 may include a hover platform 220 spaced above a base 210, which can have a top surface 211 that may be made of wood or other decorative material. The hover platforms 220 can be made of similar materials which may be magnetized or have one or more magnets embedded or integrated therein. In still another embodiment of the present disclosure, shown in FIG. 7, the game 300 can have game board 310 with a hover platform 320 having a circular or other configuration with rectangular tabs 321 extending therefrom such as for connection of guide lines 322 to towers 323.

FIG. 8 illustrates a further embodiment of the present disclosure in which the game board 400 includes a game board or base 410 made up of a plurality of pieces or sections 411, here shown as each having an octagonal cross-section, although other shapes also can be used, so as to enable formation of varying design game boards or expansion of the game board by a user, for example to add platforms for players. These pieces or sections 411 also may have varying heights, and can be formed with matable surfaces or connectors to lock the pieces together and thus define a stackable game board. Magnets can be provided under selected areas of the pieces, or, alternatively, can be place thereunder at selected locations by players, who can thus adjust the magnet positions/configurations to provide a desired stability to the hover platform 420, and correspondingly a desired challenge level to the game. The hover platform 420 may also have an octagonal cross-section, and the towers 430 may have a columnar shape with an octagonal cross-section. The boards also can be made reconfigurable. For example, multiple boards could be arranged next to each other or attached to each other side by side or front to back the function would be the same and the magnets do not need to be reconfigured.

A method for providing/playing a building brick game is further presented. According to embodiments of the present disclosure, the method may include suspending a hover platform over a game board. The method may further include adjusting the relative stability of the hover platform. The stability of the hover platform may be adjusted by changing the location of magnets attached to the base of the game board by rotating the dial, or other actuation mechanism, attached to the base of the game board.

Further, the method may include stacking stable blocks or other game pieces on the hover platform. For example, the method may include players taking turns successively stacking one or more blocks, which may be selected from a group of blocks of varying shapes, on top of the hover platform and/or on other blocks that form different/varying block arrangements supported by the hover platform. The players continue to take turns stacking blocks, and when the hover platform topples over and the stacked blocks fall off of the hover platform, the building brick game is complete. The blocks may be made up of three dimensional shapes including pyramids, corner tetra cubes, L-shaped tetra cubes, and straight tetra cubes. Selection of a particular block may be determined by rolling a die including different faces with various indicators disposed thereon, including the shape of block to be stacked or the number of blocks to be stacked and/or remove.

For example, a method of using/playing the brick building game could include the following. A 6-sided die, a pair of dice, spinner, etc. can be provided. The die can be labeled with numbers and/or letters, e.g. 1, 2 and R on various faces, wherein the number 1 indicates to place one piece, the number 2 indicates to place two pieces, while R can require a player to remove a piece (this may be any piece placed, not simply the last piece played). Players can take turns alternatively rolling the die. The first person to perform one of the following losing conditions may lose the game: (i) topple the platform such that a stacked block arrangement becomes dislodged or falls off the hover platform, (ii) knock a piece off the platform, or (iii) make the platform go so low as to touch the base. In a two player game with two platforms, the die may be used the same manner as above; however, each player can build their own platform. If both players are able to use all their pieces without hitting a lose condition, then the person with the highest structure can win. A single player challenge mode could include trying to get all the pieces onto the platform. Another game mode could include one player building the platform up completely, and another player removing the pieces systematically without knocking over the platform. Before and/or during play, players may vary or adjust the relative stability of the hover platform to increase or decrease the difficulty of play.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, this disclosure covers various modifications, combinations, alterations, etc., of the above-described embodiments, as well as various other combinations, modifications, and environments, which are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

It will be understood by those skilled in the art that while the present invention has been discussed above with respect to particular embodiments of the present invention, various additions, modifications and/or changes can be made thereto without departing from the spirit and scope of the invention.

What is claimed is:

1. A levitating stacking block game, comprising:

a game base having an upper surface at least partially defining an area of play for the stacking block game, a series of magnets disposed adjacent the upper surface, and a chamber defined below the upper surface of the game base, the chamber at least partially receiving the series of magnets;

a hover platform including a body having a top surface and at least one magnet arranged therealong, the hover platform suspended above the upper surface of the game base in a levitating arrangement generated at least in part by a magnetic repulsion between the at least one magnet of the hover platform and one or more of the series of magnets of the game base;

a plurality of game pieces having varying configurations and one or more planar surfaces, the game pieces configured to be arranged in stacked orientations on the top surface of the hover platform such that the platform at least partially supports the game pieces stacked thereon in a floating arrangement above the upper surface of the game base;

one or more supports connected to the game base along a periphery thereof; and at least one connecting member configured to connect at least one support of the one or more supports to the hover platform sufficient to substantially maintain the hover platform in a position over the upper surface of the game base while the hover platform is in the floating arrangement;

a tray at least partially received within the chamber of the game based and supporting the series of magnets;

a track connected to at least a portion of the tray and having a series of teeth disposed therealong;

a gear disposed at least partially within the chamber and including a series of gear teeth configured to engage the series of teeth of the track; and an actuator in communication with the tray and configured to cause the gear to engage the series of teeth of the track to move the tray in one or more directions therealong to adjust a position of at least one of the series of magnets in relation to the hover platform to vary stability of the hover platform, wherein, during play of the levitating stacking block game, game pieces are successively stacked upon the hover platform to form block structures of varying arrangements on the hover platform without the game pieces becoming unstacked.

2. The game according to claim 1, wherein the series of magnets are movable in at least one direction parallel to a plane of the platform so as to allow a user to adjust stability of the platform so as to provide user selectable challenge levels to the stacking block game.

3. The game according to claim 1, wherein the at least one connecting member comprises one or more wires comprising an electrically conductive material and configured to couple a power source to one or more light sources to provide illumination to the platform.

4. The game according to claim 1, wherein the one or more supports are movable between a series of locations about the periphery of the game board to adjust the stability of the platform.

5. The game of claim 4, wherein the one or more supports include at least two towers, each of the towers mounted at a corner portion of the hover platform.

6. The game according to claim 1, further comprising:

at least one additional game base configured to engage the game base in a mating relationship to expand the area of play.

7. The game according to claim 6, further comprising:

at least one additional hover platform having a magnet connected thereto, the at least one additional hover platform being suspended in a floating arrangement above the area of play at least partially by magnetic repulsion between the magnet connected thereto and one or more of the series of magnets coupled to the game base and/or the additional game base.

8. A levitating stacking block game, comprising:

a game base having an upper surface at least partially defining an area of play for the stacking block game, and a series of magnets disposed adjacent the upper surface;

a hover platform including a body having a top surface and at least one magnet arranged therealong, the hover platform suspended above the upper surface of the game base in a levitating arrangement generated at least in part by a magnetic repulsion between the at least one magnet of the hover platform and one or more of the series of magnets of the game base; and a plurality of game pieces having varying configurations and one or more planar surfaces, the game pieces configured to be arranged in stacked orientations on the top surface of the hover platform such that the platform at least partially supports the game pieces stacked thereon in a floating arrangement above the upper surface of the game base, wherein, during play of the levitating stacking block game, game pieces are successively stacked upon the hover platform to form block structures of varying arrangements on the hover platform without the game pieces becoming unstacked;

a chamber defined below the upper surface of the game base, within which a tray supporting the series of magnets is received;

a track connected to at least a portion of the tray and having a series of teeth disposed therealong;

a gear disposed at least partially within the chamber and including a series of gear teeth configured to engage the series of teeth of the track; and an actuator in communication with the tray and configured to cause the gear to engage and move the tray in one or more directions along the track so as to adjust a position of at least one of the series of magnets in relation to the hover platform to enable stability of the platform to be varied.

9. The game according to Claim 8, wherein each of the plurality of game pieces comprises a different shape, size, or configuration.

10. The game according to Claim 8, wherein the game pieces include pyramids, corner tetra cubes, L-shaped tetra cubes, straight tetra cubes, or any combination thereof.

11. The game according to Claim 8, wherein the game base comprises a series of connectable base portions, enabling creation of user defined game boards of variable sizes, arrangements, or configurations.

12. A stacking block game, comprising:

a game base including an upper surface at least partially defining an area of play for the stacking block game, and including a body with a chamber defined therein, the chamber is defined below the upper surface of the game based and at least partially receives one or more magnets therein;

a hover platform comprising a body having an upper surface, the body having at least one magnet located therealong, the hover platform being positioned at least partially above the upper surface of the game base in a floating arrangement caused, at least in part, by magnetic repulsion between the one or more magnets of the game base and the at least one magnet of the hover platform;

a plurality of supports connected to the game base along a periphery thereof, each support of the plurality of supports including at least one connecting member connecting the hover platform thereto sufficient to hold the hover platform in a substantially stable position over the upper surface of the game base while the hover platform is in its floating arrangement;

a plurality of game pieces of varying size and/or configurations, the game pieces stackable on the upper surface of the hover platform in a plurality of stacked orientations or arrangements;

a tray at least partially received within the chamber of the game base and supporting the one or more magnets received in the chamber of the game base;

a body connected to the tray and defining a track including a plurality of teeth disposed therealong;

a gear disposed at least partially within the chamber and including a plurality of gear teeth configured to engage the plurality of teeth of the track; and an actuator configured to cause movement of the gear to engage and move the tray in one or more directions along the track to adjust a position of the one or more magnets in relation to the hover platform to vary stability of the hover platform.

* * * * *